United States Patent [19]

Jacobsen et al.

[11] 4,318,493

[45] Mar. 9, 1982

[54] EASY OPENING CONTAINER

[75] Inventors: Robert Jacobsen, Wheaton; Joseph E. Connor, Palatine, both of Ill.

[73] Assignee: The Continental Group, Inc., New York, N.Y.

[21] Appl. No.: 191,223

[22] Filed: Sep. 26, 1980

[51] Int. Cl.[3] ..... B65D 17/34

[52] U.S. Cl. ..... 220/270; 220/309; 220/310; 220/269; 215/255

[58] Field of Search ..... 220/269, 270, 309, 310; 215/324, 327, 255

[56] References Cited

U.S. PATENT DOCUMENTS

| | | | |
|---|---|---|---|
| 3,522,899 | 8/1970 | Siemonsen et al. | 215/255 |
| 3,701,454 | 10/1972 | Thorp | 220/270 |
| 3,820,681 | 6/1974 | Hulse | 220/270 |
| 4,130,219 | 12/1978 | Mallorea | 220/270 |

*Primary Examiner*—George T. Hall

*Attorney, Agent, or Firm*—Charles E. Brown

[57] ABSTRACT

A closure for a thin walled metal container comprising a panel extending over the open end of the container and made of thin sheet metal such that it expands into convex shape when pressurized. Contents are placed into the container, the panel having a score therein defining a tear out portion which includes the crest of the convesity and the tear panel being ruptured along the score line by a lever tab which is secured to the panel outside the tear out portion on the slope of the convexity so that the handle portion of the tab is held firmly against the peripheral edge of the panel where it is buttressed against the top edge of the container so as to prevent accidental impacts against the handle to cause it to open the container, the handle portion of the bat being spring-loaded against a radial portion of the container below the closure at one side thereof.

11 Claims, 5 Drawing Figures

EASY OPENING CONTAINER

BACKGROUND OF THE INVENTION

This invention pertains to containers which are made of thin sheet metal such as aluminum less than 10 mils thick and which comprise as top dome-like portion which tapers to a small pour opening. Various closures have been made for the opening, most of which are plastic and require that they be inserted into the opening with a tight fit. This requires that the dome section must be constructed in such a way as to resist the axial loads imposed during insertion of the closure or complex support mechanisms must be provided to prevent axial collapse of the top during assembly with the closure.

DISCUSSION OF THE PROBLEM

Because of the thin section of the metal of the container, it is necessary to provide a closure which can be opened without rupturing the container, but which will sustain the pressure imposed thereon of between 90–140 pounds per square inch. The closure must also be easily fabricated, preferably with existing technology and machinery to minimize capital investment. It must also be unobtrusive and its operation easily perceived. The containers must also be stackable for pallatizing.

SOLUTION OF THE PROBLEM

This invention provides a closure which may be manufactured with existing equipment and which may be secured to the container preferably by adhesives or crimping to the neck of the container.

The invention comprehends forming a closure having a panel with a score which defines a tear section which is openable by a lever tab secured to the panel outside the tear section, the tab having a nose portion overlying the tear section and a handle or lift portion which unobtrusively extends to one side of the closure and is draped over a conical or dome section of the top of the container.

The invention comprehends providing a closure made of a thin sheet metal such as aluminum which comprises a top wall and a peripheral skirt portion which fits about an outturned curl at the upper end of the neck portion of the container, the lower edge of the skirt as it is being crimped under the curl, compresses a sealing material interposed between the opposing portions of the closure and curl.

One of the objects of the invention is to provide a closure of thin sheet material which will bulge outwardly upon filling of the container with pressurized contents, and employing this bulging to hold the opening tab, secured to the top of the closure, tightly against the top edge of the closure and also alongside the container so that it cannot be snagged and moved to accidentally open the container.

A different object is to provide an opening device for the closure in the form of a Z-shaped tab having (1) a top leg overlaying a rupturable top wall of the closure, (2) a vertical leg lying alongside the neck of the container, and (3) a bottom leg overlying a frusto-conical transition portion of the container joining the neck with the cylindrical body of the container.

The invention also contemplates providing an opening device or tab for the closure in which the tab has an upper portion riveted to a scored top wall of the closure generally parallel thereto in the unpressured condition of the closure, the upper portion being connected to a vertical part of a handle which lays alongside the neck of the container and at its lateral edge is abuttable with the perimeter of the top wall to prevent the tab from rotating about the rivet out of proper position with respect to the score so that upon lifting of the tab handle the upper portion of the tab will apply pressure against the top wall in a predetermined location which will cause the score to fracture and thus open the container.

The invention is applicable to glass or plastic bottles which have a bead about the upper end of the neck and provides an easy opening non-detachable device for any of the foregoing containers.

These and other objects and advantages inherent in and encompassed by the invention will become more apparent in the specification and the drawings wherein.

DESCRIPTION OF FIGS. 1–5

Figure 1:
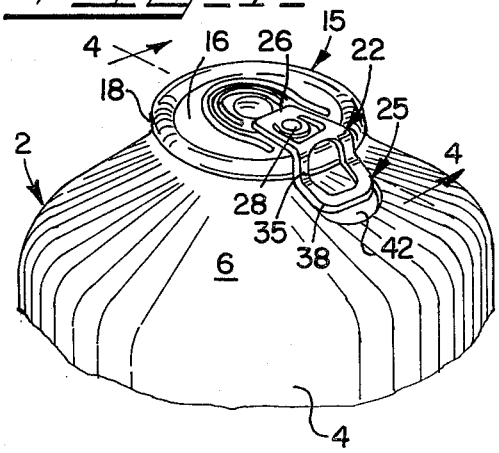
FIG. 1 is a fragmentary perspective view of a container incorporating my novel closure.
Figure 2:
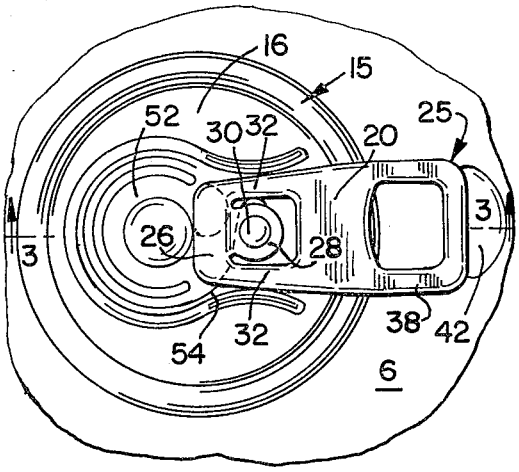
FIG. 2 is an enlarged fragmentary top plan view thereof.

The drawings illustrate a metal container generally designated 2 having a cylindrical body 4 and a bottom (not shown). The top portion 6 is a section of a cone and tapers to a narrow neck 8 which is in the form of a curl having an inner wall portion 9, an upper wall portion 10 and an outer wall portion 11.

A closure 15 is applied to the neck after the container is filled with pressurized beverage and comprises a panel 16 having a peripheral skirt 18, a portion 19 of which is precrimped in a section beneath the forward portion 20 of a handle 22 of a tab 25.

The tab 25 comprises a forward end nose portion 26, an intermediate securement portion 28 in the form of a lug which at its forward wall is hingedly connected to the rear end of the nose and at its rear and is apertured and mounted onto a rivet 20 which is integral with and formed from the panel 16. The forward portion of the handle is connected by a pair of laterally spaced legs 32, 33 to the rear end of the nose in flanking relation to the lug 28. The rear end of the forward portion 20 of the handle or lift portion of the tab is connected to the upper end of an intermediate vertical portion 35 of the handle and the lower end of portion 35 is connected to the forward end of a rear portion 38 of the handle which projects outwardly of portion 39 in closed position of the closure opposes the top surface 40 of the conical section of the body and extends over a finger-access depression 42 formed in the conical section 6.

Figure 3:
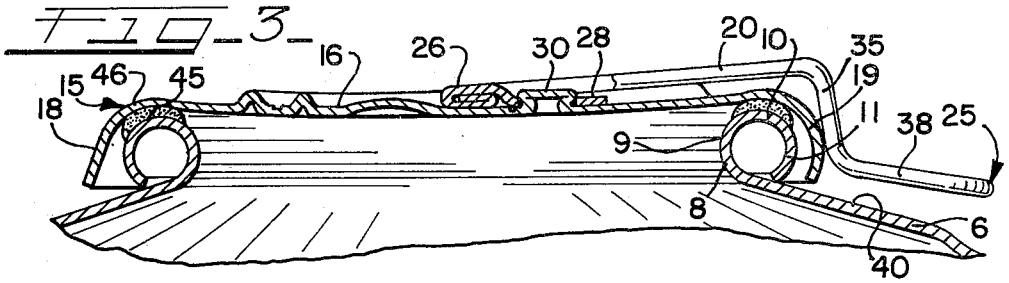
FIG. 3 is a fragmentary cross-sectional view taken substantially on line 3—3 of FIG. 2 showing the precrimped condition of the closure.
Figure 4:
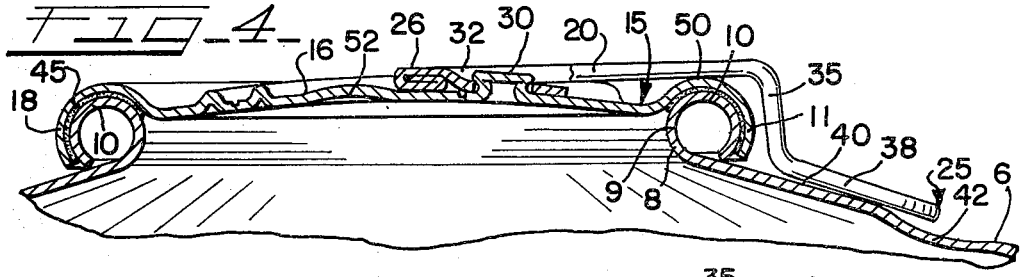
FIG. 4 is an enlarged cross-sectional view taken substantially on line 4—4 of FIG. 1.
Figure 5:
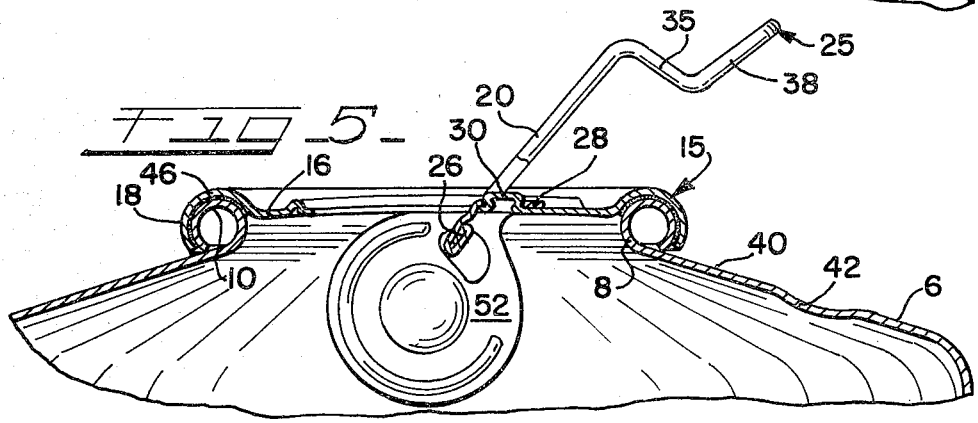
FIG. 5 is a cross-sectional view as in FIG. 4 but showing the closure in open position.

As best seen in FIG. 3, in the unpressurized condition the top panel of the closure is depressed slightly inwardly and the handle portion is thus elevated above the periphery of the panel. The 4–6 mil aluminum sheet stock from which the end closure is made will balloon out into a convex shape as seen in FIG. 4 when the skirt portion is crimped about the curl and compresses the sealing material 45 such as plastisol or the like between the peripheral portion 46 of the panel and the opposing top wall portion 10 of the curl and between the skirt and the outer wall 11 of the curl. During crimping the peripheral portion 46 as well as the skirt are formed into a U-shaped cross-section as best seen in FIGS. 4 and 5.

It will be noted in FIG. 3 that the section 19 is partially precrimped prior to application to the neck of the container so that it will clear the handle portion of the tab and also facilitate application of a crimping tool between the vertical handle portion of the tab and the outside of the section 19.

It will be noted that the geometry of the parts is so chosen that the inner or forward portion of the handle upon expension of the panel into an outwardly convex shape, will bear firmly as at 50 (FIG. 4) against the top of the peripheral portion 46 of the closure panel. Thus pallatizing of the cans is accommodated, it being understood that there is a paperboard placed over the top of each level of cans and those above seat on the paperboard on top of the level therebelow.

In order to open the container, the handle of the tab is lifted by grasping portion 38. The tab hinges at the connection of the lug 28 with the nose 26. The nose which overlies only a minor portion of the severable panel section 52 defined by score 54 in the end panel presses on section 52 causing the score 54 to rupture and section 52 to depress into the container as seen in FIG. 5. After opening, the tab is returned to the position shown in FIG. 3 by depressing the handle.

It will be appreciated that the closure is responsive to the internal pressure in the can to hold the handle in an unobtrusive position where if the tab is struck accidentally, the force will be primarily transmitted to the neck and body of the container and not to the nose of the tab in an opening sequence which requires rotation of the tab. Thus a novel and effective opening device has been provided with the attendant safeguards against accidental opening.

A further feature comprises having the other handle portion opposing the top of the cone at a radially outwardly convergent angle. The handle engages the top at 55. This has the effect of providing a shock absorbing buffer in that as the handle is depressed on the top portion 1 the bottom portion will slide on the cone and the vertical portion of the handle will flex.

I claim:

1. A closure for a thin-walled container for pressurized contents comprising a body, a bottom at one end, a dome-shaped member at the other end having a small diameter neck providing an opening for filling and pouring, a closure providing an expanded panel closing said opening, a score in said panel defining a tear out panel portion, a tab having a nose overlying said panel portion, means securing said tab to said panel outside said tear out panel portion, said tab adapted to rupture said score pursuant to lifting of the tab and thereafter to push said tear out panel portion into the container, said tab having a portion extending along said neck and engageable with a peripheral portion of said panel to maintain said tab in position to fracture said score.

2. The invention according to claim 1 and said panel having a peripheral raised portion of U-shape in cross-section defining a groove receiving a portion of said body therein, and means securing said panel to the neck comprising a skirt crimped under said neck.

3. The invention according to claim 2 and said panel expanding into convex shape upon internal pressure being applied threto and thereby swinging the inner end of the nose of the tab upwardly and the portion of the tab at the periphery of the panel downwardly for holding the tab tightly thereagainst.

4. The invention according to claim 3 and said U-shaped peripheral portion under the tab being precrimped to facilitate crimping thereof for securement to the neck.

5. The invention according to claim 1 and said tab extending beyond the periphery of the end member and having a handle portion angled alongside said body portion.

6. The invention according to claim 5 and said container being made of thin sheet metal of less than 7 mils in thickness and said tab secured to said panel below the crest of convexity thereof and said tab nose being closer to said crest than to the securement of the tab to said panel.

7. The invention according to claim 6 and said tab having portions alongside said neck and another portion over the dome in sliding contact therewith.

8. The invention according to claim 7 and said last-mentioned portion of the tab being angled toward said dome shaped member and said tab portions being resilient with a springing action to resist loads imposed thereagainst.

9. In a container for pressurized fluids having a narrow neck defining a pour and fill opening, said neck having an external curl, a closure for the container having a thin metal panel extending over the opening and a peripheral defining skirt surrounding said curl, said panel being expandable into an outwardly convex dome shape, a score in the panel defining a tear-out portion, a tab secured to the panel in an area below the crest of the dome and having one end adjacent the crest positioned to fracture said score and having another end seated against the periphery of said panel in an area in alignment with the neck for transmitting loads thereto from accidental blows struck against said tab.

10. The invention according to claim 9 and said closure being formed from aluminum and said tab widening from said one end toward the periphery of said end panel and providing a broad area of engagement thereof.

11. A closure for a pressure container having a neck with a peripheral bead, said closure comprising a thin disk portion overlying the neck and having a peripheral skirt adapted to be crimped under the bead, a non-detachable tab hingedly connected to the disk portion at one side of the center thereof and having a nose at one end and a handle at the other, a score in the disk defining a tear panel to provide a pour opening, said nose overlying said tear panel and said handle overlying said skirt and having a portion extending downwardly alongside said neck, said disk upon pressurization bulging outwardly and causing said nose to rise about the hinge axis of the tab and said handle to move downwardly against said disk and retain the portion of the handle along the neck.

* * * * *